US006586888B2

(12) United States Patent
Kitahara et al.

(10) Patent No.: US 6,586,888 B2
(45) Date of Patent: Jul. 1, 2003

(54) ORGANIC EL DRIVE CIRCUIT AND ORGANIC EL DISPLAY DEVICE USING THE SAME

(75) Inventors: Shinji Kitahara, Kyoto (JP); Kouichi Hanada, Kyoto (JP); Jun Maede, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/102,671

(22) Filed: Mar. 22, 2002

(65) Prior Publication Data

US 2002/0135314 A1 Sep. 26, 2002

(30) Foreign Application Priority Data

Mar. 26, 2001 (JP) ..... 2001-086967
Dec. 27, 2001 (JP) ..... 2001-396219

(51) Int. Cl.[7] ..... G09G 3/10

(52) U.S. Cl. ..... 315/169.1; 315/169.3; 345/84; 345/204

(58) Field of Search ..... 315/169.3, 169.4, 315/169.1; 345/204, 84

(56) References Cited

U.S. PATENT DOCUMENTS 6,486,607 B1 * 11/2002 Yeuan ..... 315/169.1

FOREIGN PATENT DOCUMENTS

JP 10-112391 4/1998

* cited by examiner

*Primary Examiner*—David Vu
(74) *Attorney, Agent, or Firm*—Mattingly, Stanger & Malur, P.C.

(57) ABSTRACT

An organic EL drive circuit comprises a first current mirror circuit provided in a drive stage of a current drive circuit having an input stage for generating a reference current and an output stage for current-driving terminals of an organic EL display panel and having n output side transistors connected in current mirror relation to an input side drive transistor, for driving said output stage, where n is an integer equal to or larger than 30 and a drive current regulator circuit for regulating drive current of said input side drive transistor. The input side drive transistor is arranged in a center portion of an arrangement of the n output side transistors and an output current of the output stage is regulated by the drive current regulator circuit.

20 Claims, 8 Drawing Sheets

ORGANIC EL DRIVE CIRCUIT AND ORGANIC EL DISPLAY DEVICE USING THE SAME

BACKGROUND OF THE INVENTION

1. Field of the Invention

The present invention relates an organic EL drive circuit and an organic EL display device using the same organic EL drive circuit and, particularly, the present invention relates to an organic EL display device, which can reduce luminance variation on a display screen of such as a portable telephone set, can achieve high integration density and is suitable for high luminance color display.

2. Description of the Prior Art

It has been known that an organic EL (Electro-Luminescence) display device, which realizes a high luminance display by light generated by itself, is suitable for a display in a small display screen and the organic EL display device has been attracting public attention as the next generation display device to be mounted on a portable telephone set, a DVD player or a PDA (Personal Digital Assistants) such as a portable terminal device, etc.

Known problems of the organic EL display device are that, when it is driven by voltage as in a liquid crystal display device, luminance thereof is substantially voltage dependent and that its sensitivity is color dependent and, therefore, a color display control thereof is difficult.

In view of these problems, an organic EL display device using a current drive circuit was proposed recently. For example, JP H10-112391 A discloses a technique with which the illumination variation problem is solved by employing the current drive system.

FIG. 7 shows an example of a current drive and control circuit of an organic EL display device of such kind, which is currently proposed, and FIG. 8 and FIG. 9 show a current drive circuit thereof.

In FIG. 7, an organic display panel 1 of the organic EL display device for a portable telephone set having 396 (=198×2) terminal pins in a column line and 162 (=81×2) terminal pins in a row line is shown. The organic display panel 1 is constructed with two EL panels 1*a* and 1*b*, which are bonded together in center portions thereof.

On the organic display panel 1, two column driver IC's 2*a* and 2*b* and two column driver IC's 2*c* and 2*d* are provided in the upper and lower EL panels 1*a* and 1*b*, respectively, and two row driver IC's 3*a* and 3*b* are provided correspondingly to the respective EL panels 1*a* and 1*b*.

In a color display device, each of the column terminal driver IC's includes 66 terminal pins for each of R, G and B colors, resulting in 198 (66×3) terminal pins forming column output lines. It should be noted that, in FIG. 7, the three different colors are shown without discrimination and, in the following description, the organic display panel 1 has the EL panels 1*a* and 1*b* each having 396 (=198×2) terminal pins as the column output lines.

A power source (battery) 4 for driving the organic EL display panel supplies electric power to the column driver IC's 2*a*, 2*b*, 2*c* and 2*d* and the row driver IC's 3*a* and 3*b*. The power source voltage thereof is within a range from 12V to 15V and it may be, for example, 15V.

These driver IC's operate according to a control signal from a controller 5. The column driver IC's are anode driving drivers for driving anodes of the EL elements and functions as current discharge side to supply currents to the organic EL elements to thereby scan respective output lines as horizontal lines. The row driver IC's are cathode driving drivers of the organic EL elements and function to sink currents flowing out from the organic EL elements to ground GND to thereby scan respective output lines as vertical lines.

The controller 5 is supplied with electric power from a power source (battery) 7 of 3V and operates under control of a MPU (Micro Processing Unit) 6. The power source 4 may be realized by boosting the voltage of the power source 7 by means of a DC-DC converter.

FIG. 8 is a circuit diagram of one of the column driver IC's 2*a* to 2*d*, which includes 198 column line current driving circuits 8 provided correspondingly to the respective output lines, for current-driving the respective output lines, and a column control circuit 9 provided commonly for the column line current driving circuits 8, for controlling them.

The column line current driving circuit 8 includes a sample and hold circuit 81 for generating a reference drive current, k-time drive current generator circuits 82 each having an input pin 82*a* supplied with the reference drive current from the sample and hold circuit 81 and amplifying the drive current k times and current mirror output circuits 83 as an output stage for further amplifying the output current of the k-time drive current generator circuits 82 k times. The column control circuit 9 includes a 4-bit D/A converter circuit 91 and a switching control circuit 92.

The sample and hold circuit 81 is a reference current generator circuit (reference power source) driven by the battery 7 of 3V and holds a current data obtained by the D/A converter circuit 91 as a current sample and generates the reference drive current corresponding to an input data value.

Output terminals of the current mirror output circuits 83 as the output stage are connected to respective column pins 84 and driven by the outputs of the k-time drive current generator circuits 82 to generate output currents each being k times the output current of the k-time drive current generator circuits 82, which is k times the reference drive current generated by the sample and hold circuit 81. Thus, the reference current generated by the sample and hold circuit 81 correspondingly to the respective column pins is amplified k×k times and outputted from the current mirror output circuits 83 to the respective column pins 84.

The generation of the output drive current, which is k×k times the reference drive current, by the k-time drive current generator circuit 81 and the current mirror output circuit 83 is to reduce the reference drive current to be generated in the sample and hold circuit 81 to the order of $\mu$ A to thereby reduce power consumption thereof.

The switching control circuit 92 of the column control circuit 9 selectively operates the k-time drive current generator circuits 82 of the column line current drive circuit 8, which are to be horizontally scanned, by sending a switching control signal in response to the control signal from the controller 5. In this case, the data corresponding to a display luminance level in the horizontal scan, which is sent from the controller 5 is preliminarily supplied to the D/A converter circuit 91. The analog signal (analog current value) obtained by the D/A converter circuit 91 is held in the sample and hold circuit 81 as a reference current. The reference current is multiplexed k×k times by the k-time drive current generator 82 and the current mirror circuit 83, which are selected by the horizontal scan, to produce a drive current and the latter current is outputted to the output pin 84.

FIG. 9 is a circuit diagram of either one of the row drivers 3*a* and 3*b*. In FIG. 9, the row driver includes 81 row line current drive circuits 10 provided correspondingly to the 81 output pins for sinking drive currents from the output lines to ground and a switching control circuit 11 commonly connected to the 81 row line drive circuits 10. In FIG. 9, however, only one row line current drive circuit 10 corresponding to a row side pin 81*a* is shown for simplicity of illustration.

The row line drive circuit 10 is the so-called push-pull output circuit including transistors Tr1 and Tr2, which are driven in the push-pull manner according to a drive signal from the switching control circuit 11. Incidentally, when an output pin to be vertically scanned is selected, the transistor Tr2 on the pull side is turned ON and becomes the current sink side, so that the current, which is outputted from the column side and drives the organic EL element, is sunk to ground GND.

The switching control circuit 11 performs the vertical scan according to the control signal from the controller 5.

In the current-driven organic EL display panel 1 having a large number of pins on the column side, there are problems that a plurality of column driver IC's are required and that luminance of the display panel is varied every drive IC due to variation of drive currents of the drive IC's.

As measures against these problems, the drive circuit is formed by using IC's having substantially equal drive current characteristics. In such case, however, a severe selection of IC's is necessary, resulting in an increased number of manufacturing steps. In addition, in a color display, characteristics of IC's for the respective R, G and B becomes a problem and it is difficult to appropriately select IC's having required characteristics even if the selection of the IC's is performed inadequately, variation of luminance at a joint between adjacent drive IC's tends to occur.

When the number of pins of the column terminal drive IC becomes nearly equal to 100 or more (30 pins or more for each of R, G and B), it is difficult to regulate current values of the respective pins on the column side. In addition, in a color display, luminance characteristics of one IC for the respective R, G and B is varied It may be considered in order to regulate the current values that a number of dive current regulation circuits are provided within the IC. However, in such IC, the integration density of the original column current drive circuit is degraded. In order to avoid the degradation of integration density, it may be considered that an external drive current regulation circuit for regulating current from the battery is connected to each IC.

On the other hand, the reduction of size as well as thickness of the organic EL display panel is highly requested and a peripheral mounting area of the panel is limited. Therefore, it is very difficult to mount such external drive current regulation circuits in such limited area. Further, in the above mentioned column line current drive circuit, a number of current mirror circuits corresponding to the number of the pins are required and the number of transistors is increased. Consequently, the lager the number of the output pins results the lower the integration density of IC.

SUMMARY OF THE INVENTION

An object of the present invention is to provide an organic EL drive circuit of an organic EL display device, which can reduce the luminance variation in a display screen thereof and have a high integration density.

Another object of the present invention is to provide an organic EL display device, which can reduce the luminance variation in a display screen thereof, have a high integration density and is particularly suitable for use in a high luminance color display.

In order to achieve the above objects, an organic EL drive circuit according to the present invention is featured by comprising a first current mirror circuit provided in a drive stage of a current drive circuit having an output stage for current-driving one of terminals of an organic EL display panel and including n output side transistors connected in current mirror relation to an input side drive transistor, for driving said output stage, where n is an integer equal to or larger than 30, and a drive current regulator circuit for regulating drive current of the input side drive transistor. The input side drive transistor is arranged in a center portion of an arrangement of the n output side transistors and an output current of the output stage is regulated by the drive current regulator circuit.

In the organic EL drive circuit, the drive current regulator circuit is regulated during a fabrication of an IC such that the output current for at least a specific one of the column terminals of the organic EL panel or a current of the output side transistors for the specific terminal becomes a predetermined value.

In a current drive circuit having an input stage for generating a reference current and a current output circuit for current-driving terminals of an organic EL display panel as an output stage, the present inventors constituted, in order to improve the integration density thereof, a drive stage circuit between the input stage and the output stage with a current mirror circuit composed of n output side transistors corresponding to respective pins and one input side drive transistor. Further, in order to remove luminance variation due to column terminal drive IC's having different characteristics, the present inventors provided a regulator circuit for regulating a reference current (or reference drive current) by selecting resistance values in the column driver IC's, so that the reference current of each of the column terminal drive IC's is regulated by trimming the regulator circuit with laser.

According to this construction, an area of the EL display panel is not increased even if the output current regulator circuit is provided on the EL display panel. However, it has been found that luminance variation occurred correspondingly to the column terminal drive IC's.

The reason for this will be described. When the number of output pins of the column terminal IC becomes as large as 100 (33 or more for each of colors R, G and B), the drive currents are generated by a current mirror circuit having outputs the number of which is 30 or more for one input side, In other words, the output pins are driven in parallel by currents from one reference power source. Therefore, the output currents become different slightly each other, so that there is a difference in output drive current between the first output pin and the last output pin.

In view of this, the present inventors decided that a current regulation is performed such that a current of a last pin of an initial column terminal drive IC becomes equal to a current of a first output pin of a next column terminal drive IC. With such scheme, there may be no luminance variation due to column terminal drive IC's having different characteristics. However, in the color display, the difference in current between the first pin and the last pin varies between colors. In other words, the luminance characteristics (see FIG. 3) for pin arrangements of colors are different. Therefore, it is difficult to regulate the luminance variation as a whole and the working efficiency is low.

In the color display, the pins for R, G and B are arranged repeatedly sequentially. Therefore, the relation between the last pin of a certain column terminal drive IC and the first pin of a next column terminal drive IC corresponds to the relation between the third pin from the last pin of n pins and the first pin of the next column terminal drive IC for color G, to the relation between the second pin from the last pin and the second pin of the next column terminal drive IC for R and to the relation between the last pin and the third pin of the next column terminal drive IC for color B.

The luminance variation in the case where output pins are driven in parallel by currents from one reference power source will be described in more detail. The luminance variation due to difference of the drive current for the column terminal drive IC's may not be serious when the number of pins of R, G and B are about 10, respectively. However, it has been found that, when the number of pins of the column terminal drive IC for each of R, G and B colors becomes 33, the luminance variation becomes serious. It has been found that such luminance variation can not be reduced even if the number of 33 pins for each of R, G and B is reduced by about 10%, respectively. The output currents of current mirror output circuits for supplying drive currents to the column output pins of the column terminal drive IC's for colors R, G and B were measured and output pin vs. output current characteristics shown in FIG. 3 was obtained for the respective colors. In FIG. 3, abscissa indicates positions of the output column side output pins and ordinates indicates an output current Io. In order to solve the problem of difference in characteristics curves of the column terminal drive IC's for colors G, R and B, it has been considered as mentioned previously to provide the reference current source and the current regulator circuit for each of R, G and B and to regulate the currents by laser trimming. However, as shown in FIG. 3, the difference between the characteristics curves for R, G and B are too large to restrict the luminance variation. The present inventors investigated the reason for such large difference in the R, G and B characteristics curves and have found that the large difference is due to the drive stage of the current mirror circuit including one input side transistor and 33 output side transistors. That is, when, in order to reduce the power consumption, the drive current to be generated in the output side transistors of the current mirror circuit is set to the order of $\mu$A, the characteristics curves for these colors become difficult.

That is, the characteristics curves are largely influenced by the wiring resistance due to miniaturization of the wiring line for generating such small currents in the drive circuits, the degradation of the base-emitter characteristics due to miniaturization of the transistors of the drive circuits and the layout of the R, G and B drive circuits.

In the layout of the driver circuits for colors R, G and B, the driver circuits for colors G and B are usually arranged on both sides of the driver circuit for color R. Therefore, the current drive lines for R, G and B are different. Further, it becomes difficult to widen the drive wiring line with increase of the number of the output pins, so that the width thereof is usually several tens microns and the wiring resistance can not be reduced sufficiently. In addition, the wiring line is formed of such as aluminum whose electric conductivity is relatively low. That is, the resistance of the unit length of wiring becomes relatively large. Although the integration density of IC is improved by reducing the width of the wiring line, the output pin vs. output current characteristics thereof is degraded. Further, when the width of the power supply line, which is common for the output transistors of the drive circuit, is reduced, the drive current vs. pin characteristics is degraded.

In order to solve these problems, the integration density is improved by providing, as the drive stage for the output stage of the current drive circuit of the column lines of the organic EL display panel, the current mirror circuit having a output side transistors for each input side drive transistor, where n is an integer equal to or larger than 30. Further, the input side drive transistor is arranged in substantially the center of the arrangement of the n output side drive transistors, so that the drive current of the first pin becomes substantially equal to the drive current of the last pin for the R, G and B, which are arranged in substantially symmetrical positions about the center. With these schemes, the knoll type drive current characteristics is obtained. As a result, the luminance characteristics for the pin arrangement becomes similar to the drive current characteristics. Further, the drive current for at least a specific pin of the pins of each of colors is regulated to a predetermined value by the drive current regulator circuit.

With these measures against the problems, the output pin vs. output current characteristics of the current drive circuit for each color according to the present invention becomes substantially symmetrical knoll type curve such as shown in FIG. 4 and the position in the height direction of the knoll type characteristics curve can be regulated by the drive current regulator circuit. Therefore, it becomes possible to make the output pin vs. output current characteristics for colors R, G and B substantially equal. Further, the knoll type characteristics curve of the drive current can moderate the luminance variation in the pin arranging direction.

As a result, the current drive circuit according to the present invention can reduce the variation of drive current between the column terminal drive IC's and can suppress the variation of luminance between a certain column terminal drive IC, that is, the anode drive IC of the organic EL, and a next column terminal drive IC (anode drive IC). Therefore, it becomes possible to reduce the luminance variation on a whole display screen to thereby provide an organic EL display device having an improved integration density and a capability of high luminance color display.

According to the present invention, it is possible to make the luminance characteristics curves for color R, G and B even in one column terminal drive IC (anode drive IC of the organic EL), so that it is possible to realize the column terminal drive IC of the organic EL display device suitable for high luminance color display.

Incidentally, in the following description for each of R, G and B, the drive pins of the column direction in the description for each of R, G and B are numbered from 1st to 33rd and, in the description for R, G and B as a whole column terminal drive IC, the pins are numbered from 1st to 99th without distinction between R, G and B.

DETAILED DESCRIPTION OF THE PREFERRED EMBODIMENTS

Figure 1:
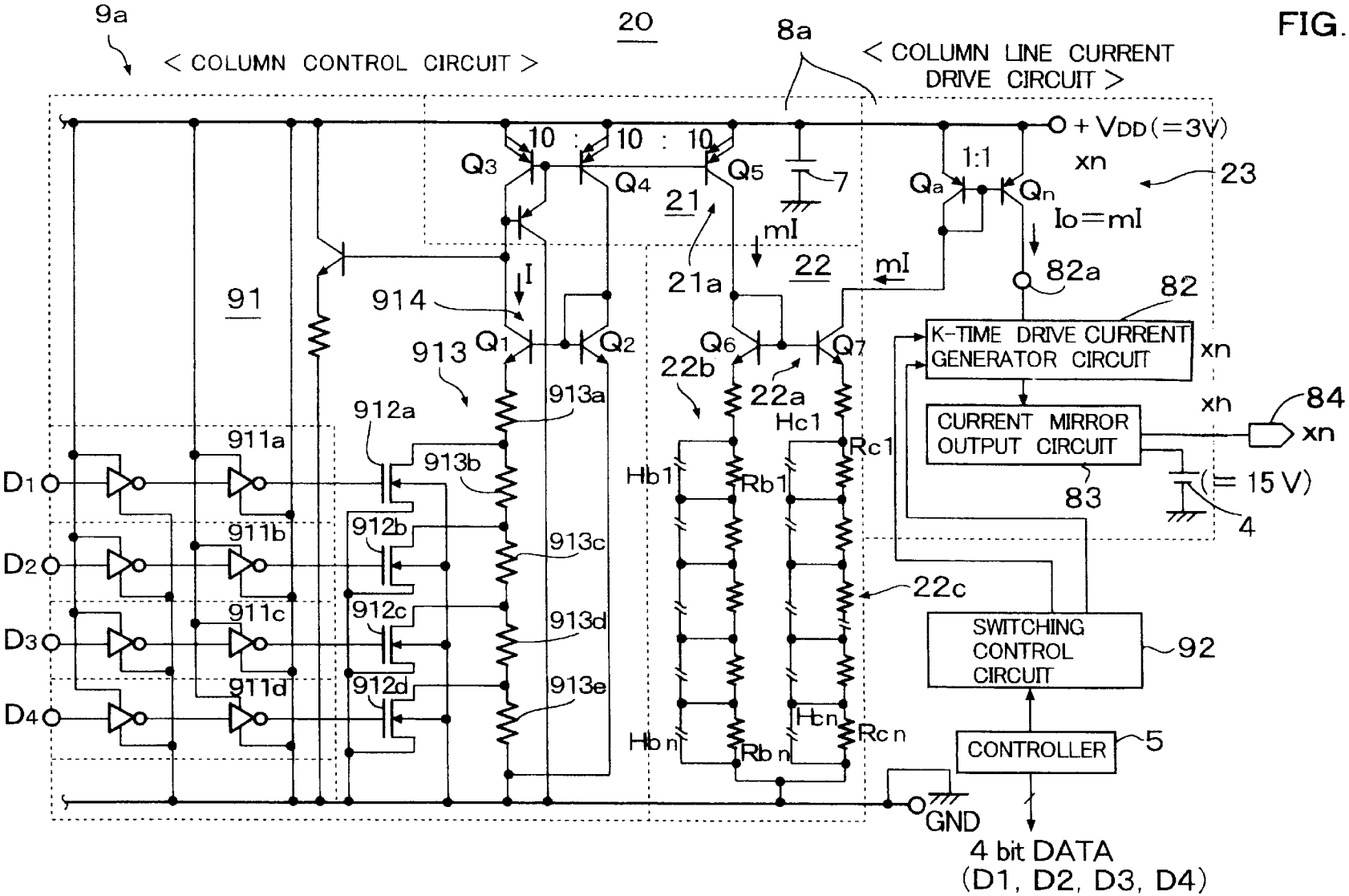
FIG. 1 is a block circuit diagram of an embodiment of an organic EL driver according to the present invention.
Figure 7:
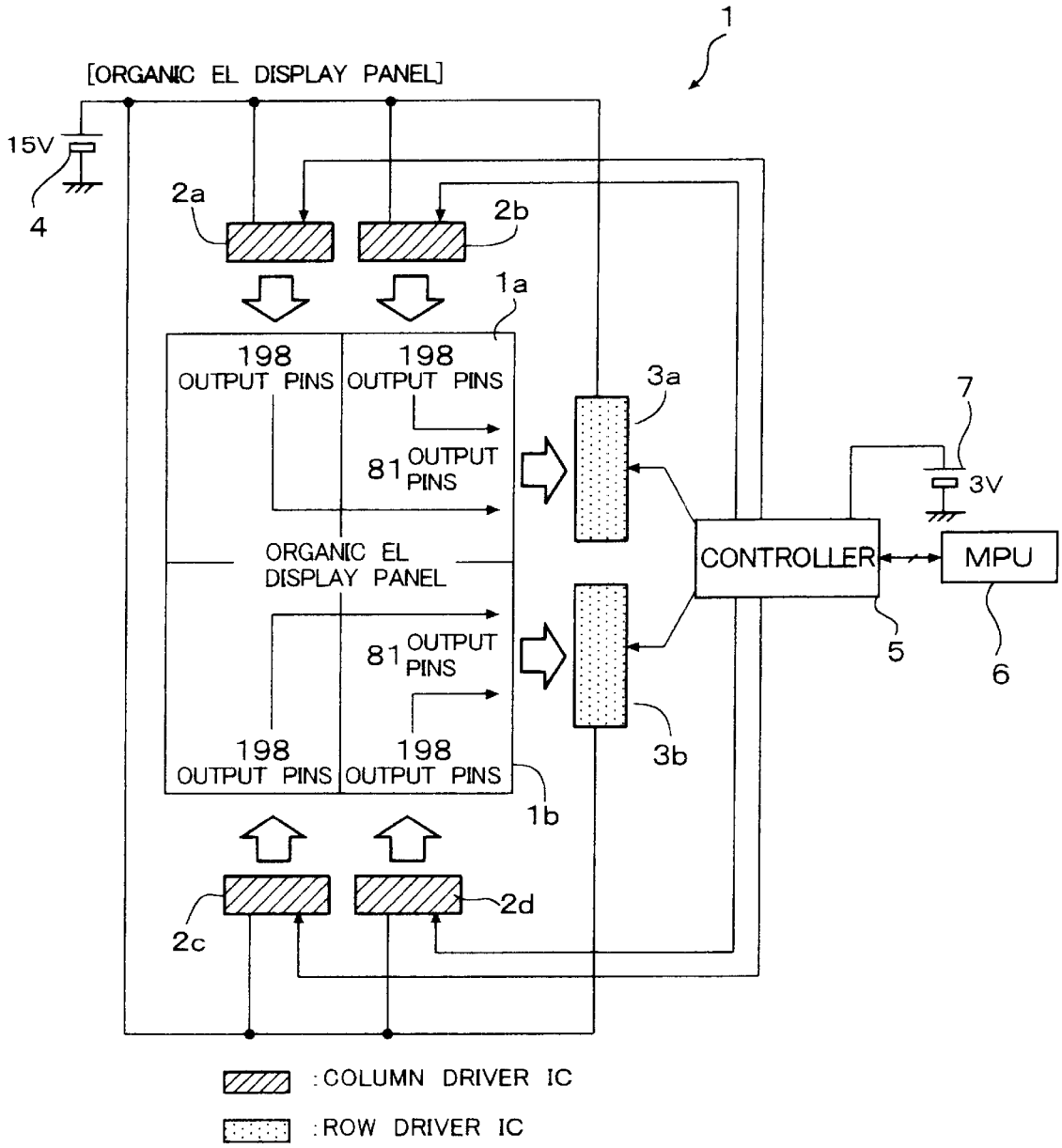
FIG. 7 PRIOR ART
FIG. 7 is a block circuit diagram of a conventional organic EL drive circuit.
Figure 8:
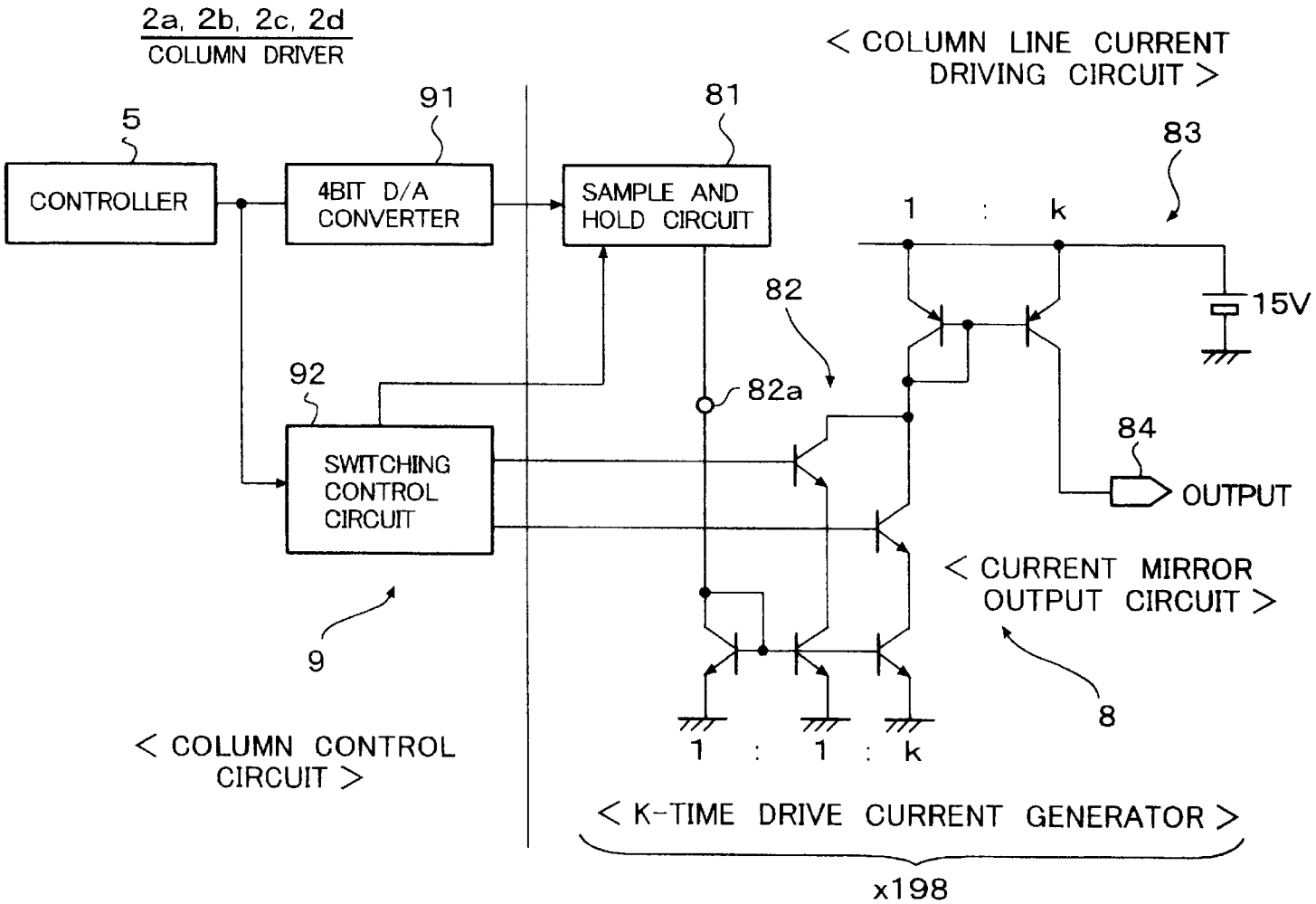
FIG. 8 PRIOR ART
FIG. 8 illustrates a column driver shown in FIG. 7.
Figure 9:
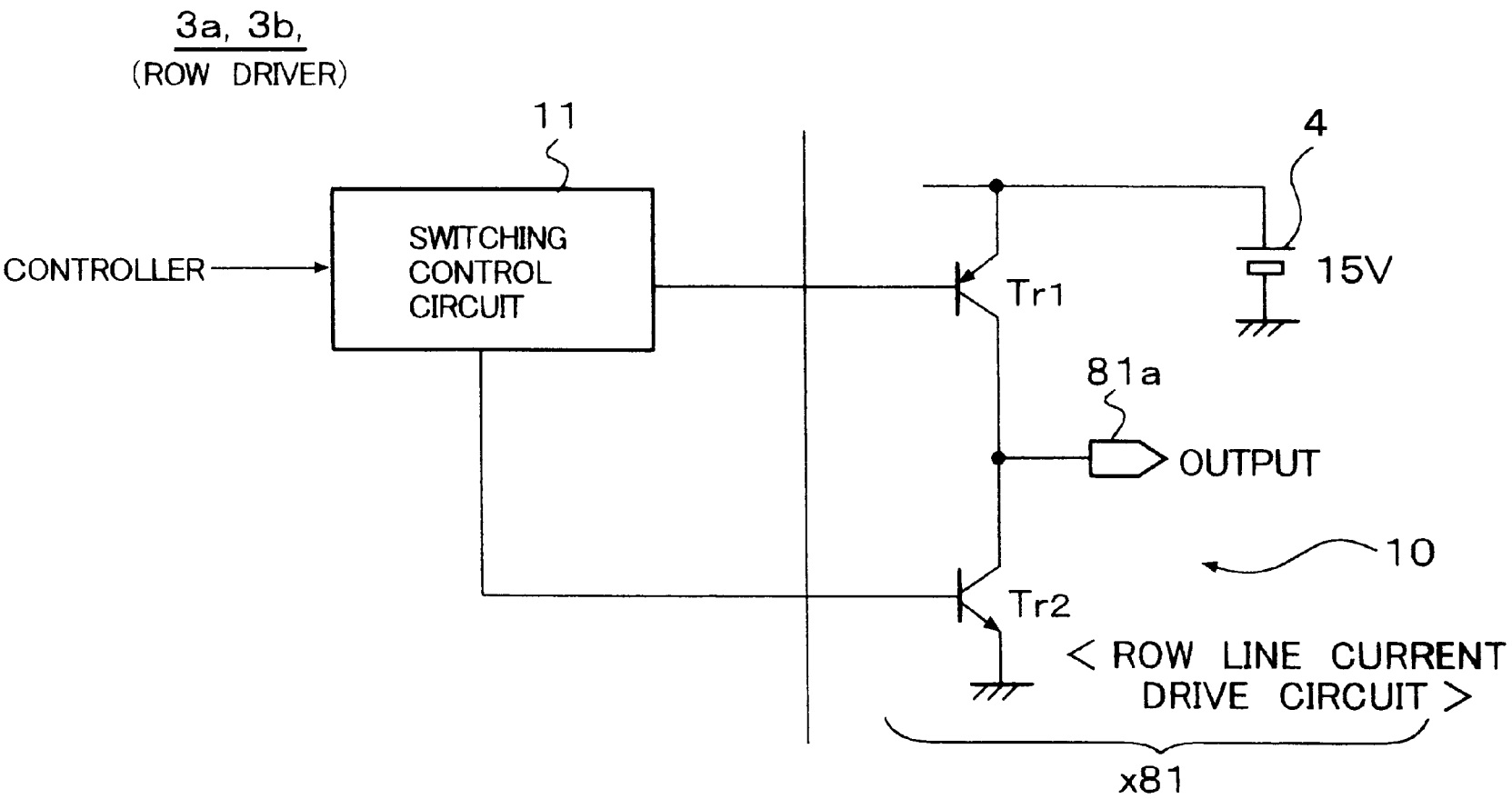
FIG. 9 PRIOR ART
FIG. 9 illustrates a row driver shown in FIG. 7.

In FIG. 1, in which the same components as those shown in FIG. 7 and FIG. 8 are depicted by the same reference numerals as those used in these figures, respectively, a column driver 20 of an organic EL drive circuit includes a column control circuit 9*a* and a column line current drive circuit 8*a*.

The column control circuit 9*a* includes a 4-bit D/A converter circuit 91 and a switching control circuit 92 (not shown), which is the same as the switching control circuit 92 shown in FIG. 8. The column line current drive circuit 8*a* includes a reference current inversion circuit 21, a drive current regulator circuit 22 for laser trimming, a drive current generator circuit 23, a plurality (n) of k-time drive current generator circuits 82 each for amplifying an output current of the drive current regulator circuit 22 k times and a plurality (n) of current mirror output circuits 83 each for amplifying the output of each k-time drive current generator circuit 82 k times. The n k-time current generator circuits 82 and the n current mirror output circuit 83 are the same as those shown in FIG. 8, where n in this embodiment is 33. In a case of a color display, the D/A converter circuit 91 and the column line current drive circuit 8*a* are included in a column terminal drive IC for each of colors R, G and B.

In this embodiment, the number of the drive pins for each of colors R, G and B is 33, so that a total number thereof is 99. Therefore, each drive current generator circuit 23 generates 33 current signals correspondingly to the 33 drive pins. The 33 drive current signals generated by the drive current generator circuit 23 are in one-to-one correspondence to the output currents (pin drive currents) outputted by the current-mirror output circuits 83 to the respective output pins 84.

Practically, the reference current inverter circuit 21 takes in the form of a circuit for generating a peak current for initial charging of the organic EL element as a capacitive load for an initial constant driving period and includes a control circuit for generating the peak current. Since, however, the control circuit is not related to the present invention directly, the control circuit portion is not shown.

The drive current generator circuit 23 includes an input side PNP bipolar transistor Qa having an emitter connected to a line +VDD (=3V) of the power source 7 and 33 output side PNP bipolar transistors Qn. The input side transistor Qa has a collector supplied with a drive current mI regulated by the drive current regulator circuit 22.

Figure 2:
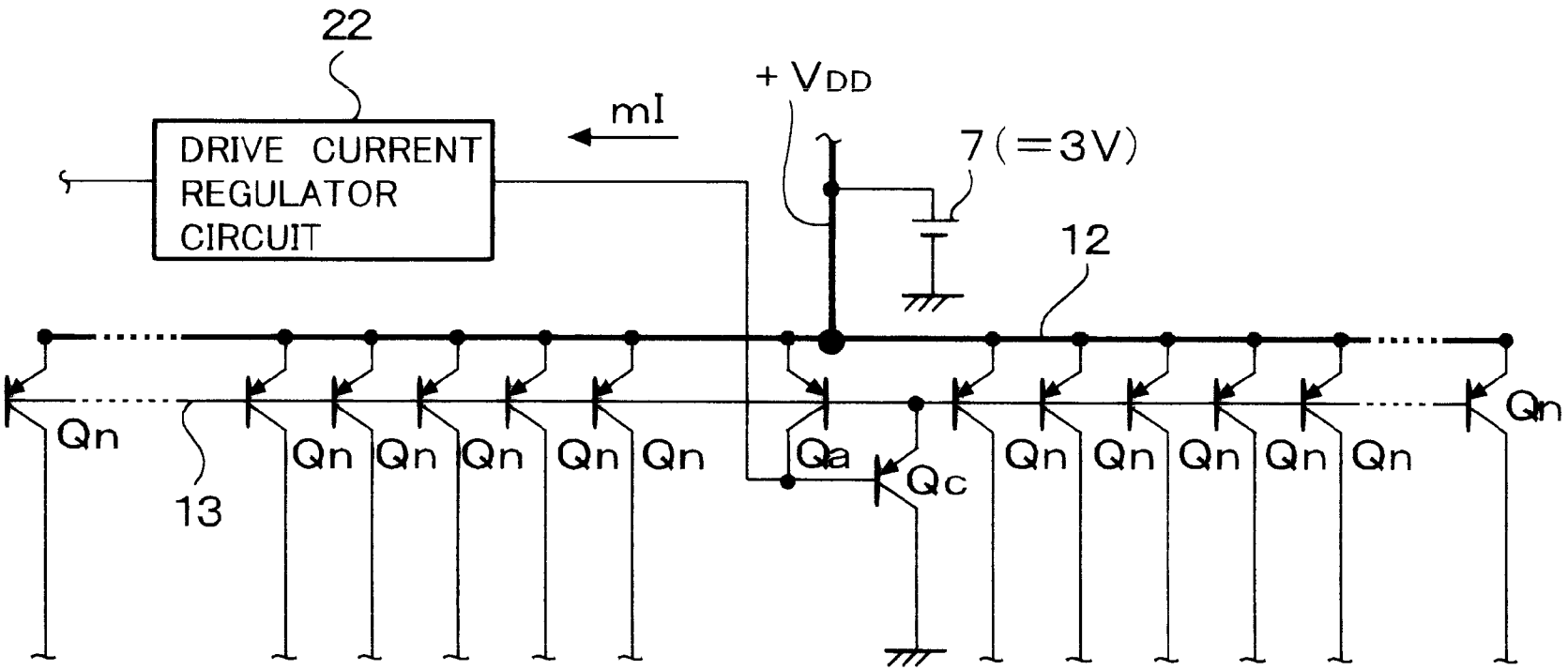
FIG. 2 is a circuit diagram of an output circuit of the embodiment shown in FIG. 1.
Figure 3:
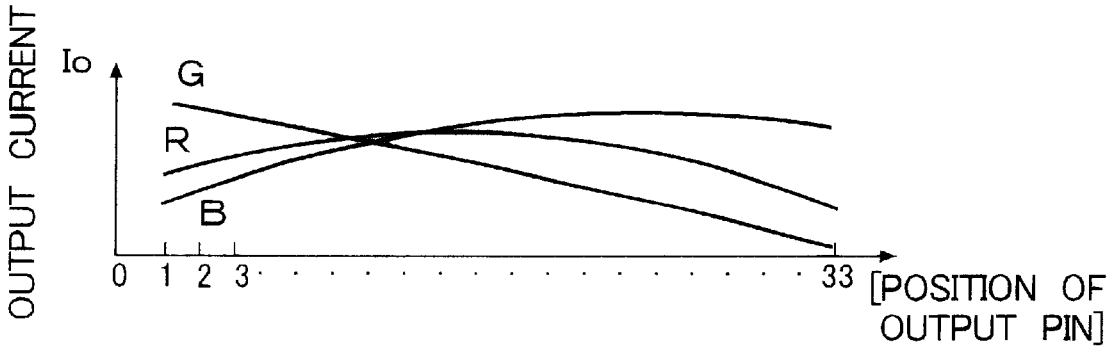
FIG. 3 shows the output pin vs. output current characteristics without the present invention.

The transistor Qa has an emitter area, which is equal to an emitter area of each of the n transistors Qn and is arranged in substantially a center position of a drive wiring line 13 of the 33 output side PNP transistors Qn to which base electrodes of the transistors Qn are connected in parallel. That is, the center position is between the 16th pin and the 17th pin, as shown in FIG. 2. Incidentally, a transistor Qc, which is not shown in FIG. 1, is provided to correct base currents of the 33 transistors Qn as shown in FIG. 2, which shows the column line current drive circuit.

In FIG. 2, a power source line +VDD from a power source 7 is connected to substantially a center position of a power supply line 12 to which the emitters of the 33 transistors Qn are connected. An emitter of the transistor Qa is also connected to the substantial center position of the power supply line 12.

The collectors of the transistors Qn are connected to the input terminals 82*a* of the plurality (n) of the k-time drive current generator circuits 82, respectively. The k-time drive current generator circuits 82 are provided correspondingly to the respective column line drive pins and drive the respective current mirror output circuits 83. Incidentally, the current amplification of the current mirror output circuit 83 may be not always k times.

The D/A converter 91 is constructed with buffer amplifiers 911*a* to 911*d* each including series connected two inverters inputted with a digital 4-bit data, N channel MOS FET switch circuits 912*a* to 912*d* connected to outputs of the respective buffer amplifiers, a series resistance circuit 913 including series-connected resistors 913*a* to 913*e* and a current mirror circuit 914 including an input side NPN transistor Q1 having an emitter connected to the series-connected resistance circuits and an output side NPN transistor Q2 connected to the NPN transistor Q1 in a current mirror relation.

The series resistance circuit 913 is connected between the emitter of the transistor Q1 and ground GND and the N channel MOS FET switch circuits 912*a* to 912*d* are connected between respective junctions of the series resistors of the series resistance circuit 913 and ground GND.

Each of the N channel MOS FET switch circuits 912 is ON/OFF controlled according to an input data (data for setting the reference current value) so that a current I corresponding thereto flows to the emitter of the input side transistor Q1 and a similar current to the current I flows to the collector of the output side transistor Q2, alternately. As a result, the A/D converted current value I from these transistors as a current value indicative of a display level.

The reference current inverter circuit 21 is constructed with a current mirror circuit 21*a* composed of input side PNP transistors Q3 and Q4 having collectors supplied with the converted current value I from the D/A converter circuit 91 and an output side PNP transistor Q5 having a base connected to bases of the input side transistors Q3 and Q4 in current mirror relation. The transistors Q3, Q4 and Q5 have emitters connected to the power source line +VDD from the battery 7. The collector of the transistor Q3 is connected to the collector of the transistor Q1 and the collector of the transistor Q4 is connected to the collector of the transistor Q2.

Ratio of emitter areas of the transistors Q3, Q4 and Q5 is 10:10:10. Since the ratio of the emitter area of each of the transistors Q1 and Q2 in the down stream of the transistors Q3 and Q4 to the emitter area of each of the transistors Q3 and Q4 is 1/10, current ratio of the transistors Q3, Q4 and Q5 becomes 1:1:1. For example, by setting the emitter area ratio of each of the transistors Q3 and Q4 to the transistor Q5 to 1:10, that is, setting m to 10, a current ml from the collector of the transistor Q5 becomes 10 times I. It should be noted that m=10 is for the drive circuit for color R and m=6 is for each of the drive circuits for colors G and B.

In order to absorb the luminance difference for the drive currents for colors R, G and B, the current ratio is regulated according to the emitter area ratio 10:10:10 of the transistors Q3, Q4 and Q5. In this case, it is possible to generate the peak current by providing another output side transistor connected in parallel to the transistor Q5 and ON/OFF controlling the newly provided output transistor. However, the control circuit therefor is not shown as mentioned previously.

The output current ratio of the transistors Q3, Q4 and Q5 can be regulated by connecting 10 transistors each being the same as the transistor Q1 or Q2 in parallel to each other and selecting the number of connections thereof during the fabrication step of the IC. Therefore, it is possible to regulate the reference currents correspondingly to the luminance characteristics for respective colors R, G and B.

The current mI is generated as the reference drive current by multiplying the analog current value I from the D/A converter circuit 91 by m by the current mirror circuit 21*a* correspondingly to each of the colors R, G and B and is sent to the drive current regulator circuit 22.

The drive current regulator circuit 22 for laser trimming is constructed with a current mirror circuit 22*a* and laser trimming resistance circuits 22*b* and 22*c*. The current mirror circuit 22*a* is constructed with an input side NPN transistor Q6 having a collector supplied with the current mI from the reference current inverter circuit 21 and an output side NPN transistor Q7 connected to the transistor Q6 in current mirror relation. The laser trimming resistance circuits 22*b* and 22*c* are connected between the emitters of the transistors Q6 and Q7 and ground GND, respectively. The laser trimming resistance circuit 22*b* is constructed with series-connected resistors Rb1 to Rbn and trimming fuses Hb1 to Hbn connected in parallel to the respective resistors. The laser trimming resistance circuit 22*c* is constructed with a series circuit of resistors Rc1 to Rcn and trimming fuses Hc1 to Hcn connected in parallel to the respective resistors Rc1 to Rcn. By selectively cut the fuses connected in parallel to the respective resistors of each of the laser trimming resistance circuits 22*b* and 22*c*, a resistance value of the series connected resistors in the downstream of the current mirror circuit 22*a* can be selected.

In this embodiment, the transistor Qa is arranged in substantially a center position of the drive wiring line 13 of the parallel-connected n transistors Qn as shown in FIG. 2. Therefore, the base electrodes of the transistors Qn become common and the base drive currents are supplied to the center position of the drive wiring line 13. The center position in the arrangement of the 33 drive pins of the column line for driving the current mirror output circuit 83 for each of the colors R, G and B is between the 16th pin and the 17th pin thereof. In order to facilitate the understanding of the present invention, the drive current for driving the current mirror output circuit 83 will be described by referring to the position of the drive pin.

The drive current supplied to the collector of the input side transistor Qa of the current mirror flows out from the output side transistors Qn of the current mirror to the output pins as drive currents. In this case, current substantially equal to the current flowing to the base of the transistor Qa flows to the commonly connected bases of the 33 transistors Qn. A voltage by which the base current flows is reduced gradually toward both directions symmetrically about the center of the base wiring line 13 due to the finely sectioned base wiring line 13, that is, the increased integration density of the transistors. Therefore, although the reduction rate of the voltage is small, the base current flowing to the bases of the transistors Qn nearest to the center between the 16th and 17th pins becomes maximum and the base current of the transistor Qn is gradually reduced symmetrically about the center toward the 33rd and to the 1st pins.

As a result, the distribution of the drive current has a peak at the center and gradually reducing portions on both sides thereof. In this case, the drive currents of the first pin and the last pin become substantially equal. Further, by regulating a drive current of a predetermined pin by the drive current regulator circuit 22 such that it becomes a predetermined value, the output pin vs. output current characteristics of the drive current of the current mirror output circuit 83 for each of R, G and B becomes as shown in FIG. 4.

Consequently, even when a plurality of the column terminal drive IC's having substantially equal characteristics as mentioned above are arranged, the luminance variation of the whole panel including the junction portions between adjacent IC's hardly becomes conspicuous.

In the above mentioned case, the power source line +VDD of 3V is connected to the center portion of the power supply line 12 of the transistors Qn, which corresponds to the position to which the emitter of the transistor Qa is connected, that is, the position between the 16th pin and the 17th pin.

Figure 4:
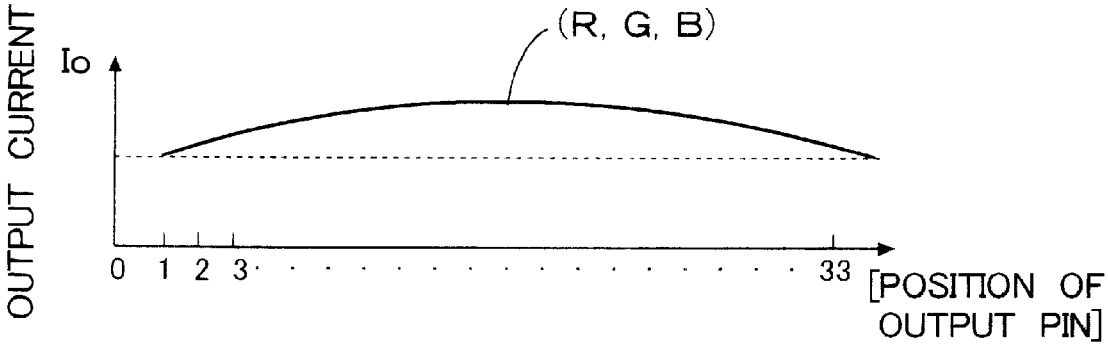
FIG. 4 shows the output pin vs. output current characteristics according to the present invention.

As a result, even in a case where the driver circuit for R is arranged centrally and the driver circuits for G and B are arranged on both sides thereof, it is possible to make the output pin vs. output current characteristics thereof for R, G and B coincident as shown in FIG. 4 by arranging the transistors Qa and the transistors Qn in the center portions of the drive line as shown in FIG. 2, respectively. As mentioned previously, the column line current drive circuit 8*a* is provided for each of R, G and B and can be regulated independently.

In each of the column line current drive circuit 8*a*, it is possible to make the drive current of the final pin substantially equal to that of the first pin by regulating the drive current of the 1st pin by the drive current regulation circuit 22 in the laser trimming step. Therefore, there is no luminance variation between the parallel column terminal IC's regardless of the number thereof.

Incidentally, in the whole column terminal drive IC's, the pin number is assigned from the 1st to the 99th pins without distinction of colors. In the column line drive circuit 8*a* of, for example, green color (G), the 1st pin of the column terminal drive IC having 99 pins is the first output pin and the 97th pin thereof is the last output pin thereof. On the other hand, in the column line drive circuit 8*a* for red color (R), the 2nd pin of the column terminal drive IC is the first output pin and the 98th pin thereof is the last output pin thereof and, in the column line drive circuit 8*a* for blue color (B), the 3rd pin of the column terminal drive IC is the first output pin and the 99th pin thereof is the last output pin.

Incidentally, the drive current regulation of the column line current drive circuit 8*a* may be performed for each of the plurality of the column terminal drive IC's mounted on the organic EL display panel by setting the input data for each of colors R, G and B, which is to be digital to analog converted, to a common data and by regulating the drive currents of the first output pins or the last output pins by the drive current regulator circuit 22 such that these drive currents become equal. The luminance regulation is performed such that the input data of the D/A converter circuit 91 becomes the maximum.

With such regulations, it becomes possible to prevent the luminance of the junction between adjacent column terminal drive IC's from being varied.

Further, by regulating the luminance characteristics such that a center portion thereof becomes the maximum luminance as shown in FIG. 4, the overall luminance variation can be made inconspicuous.

Incidentally, in the usual organic EL, the luminance of red (R) is lower than others and the drive current ratio between G, R and B becomes approximately 3:5:3. As mentioned previously, the difference in drive current between them is corrected by setting the reference currents by selecting the emitter area ratio of the reference current inverter circuit 21. An auxiliary luminance regulation can be further performed by the drive current regulator circuit 22. Further, the drive current regulator circuit 22 can perform not the auxiliary luminance regulation but the main luminance regulation by setting the dynamic range of regulation thereof large. In such case, the luminance regulation by the reference current inverter circuit 21 according to the emitter area ratio becomes unnecessary. In view of this, the emitter area ratio of the transistors Q3, Q4 and Q5 is set to 10:10:10, as mentioned previously.

Since the conventional row driver can be used in this embodiment, the detailed description thereof is omitted in this description.

Figure 5:
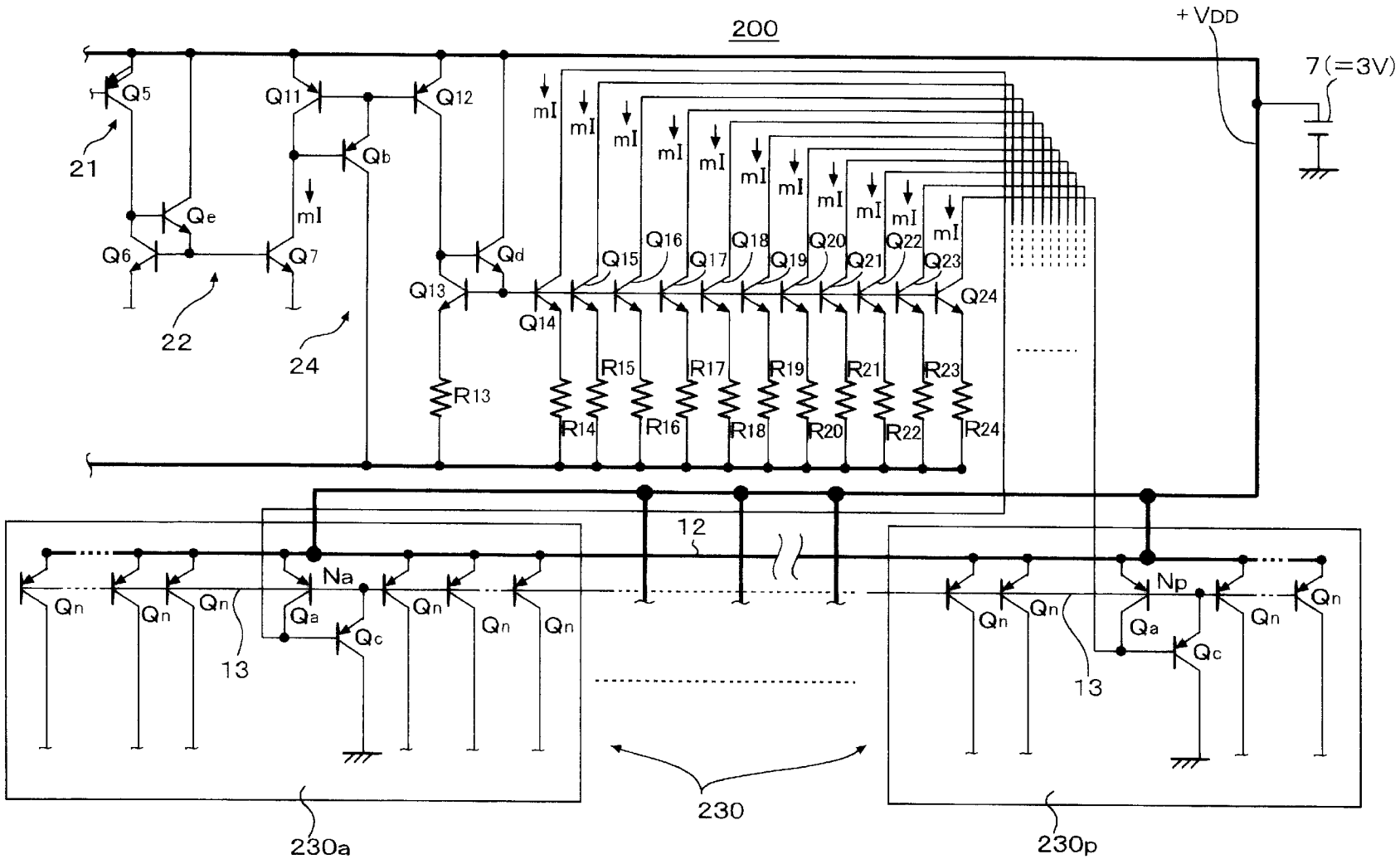
FIG. 5 is a block circuit diagram of a drive stage of another embodiment of an organic EL driver according to the present invention.
Figure 6:
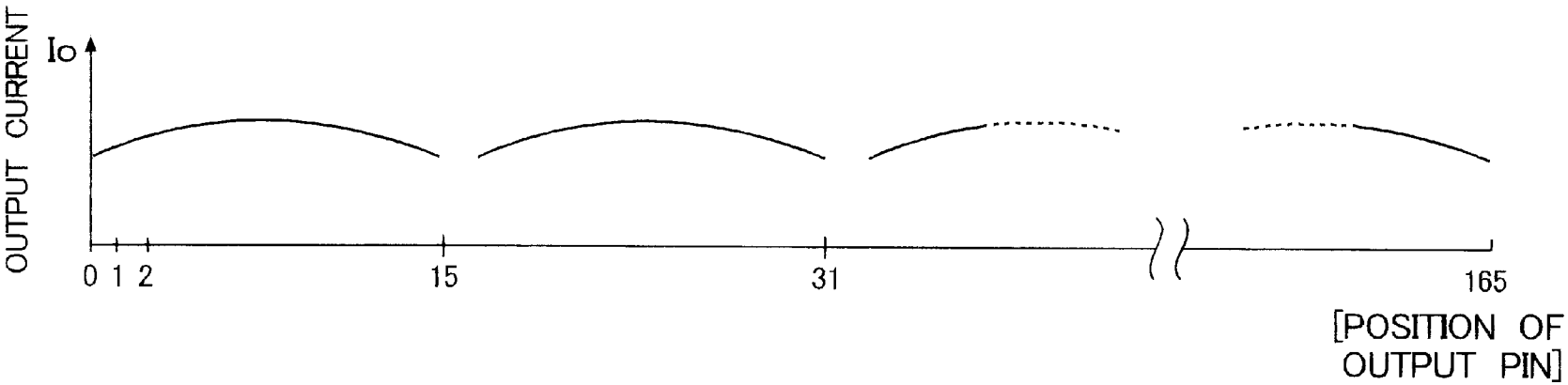
FIG. 6 is shows the output pin vs. output current characteristics according to the another embodiment.

FIG. 5 is a block circuit diagram of a column line current drive circuit of the organic EL drive circuit according to another embodiment of the present invention and FIG. 6 shows an output pin vs. output current characteristics thereof. Components shown in FIG. 5, which are the same as those shown in FIG. 1, are depicted by the same reference numerals, respectively.

In FIG. 5, the organic EL drive circuit 200 includes a drive current generator circuit 230 instead of the drive current generator circuit 23 of the column driver shown in FIG. 1.

The drive current generator circuit 230 differs from the drive current generator circuit 23 in that the number of current mirror circuits of the driver stage for each input transistor is smaller than 30 or more. Therefore, the driving point of the drive current generator circuit 230 is divided by P to points Na to Np. Each of the divided circuit groups is constructed with current mirror circuits 230*a* to 230*b* each including 14 to 16 output side transistors for one input side transistor. That is, the number of the input side transistors Qn of the center portion is P in FIG. 5 compared with those in FIG. 4 and the current mirror circuit is divided to P current mirror circuits having P driving points and each of the P current mirror circuits generates the drive current.

In the case where the 33 output pins are provided for each of R, G and B in FIG. 1, P=2. However, a case where the number of the output pins is 165 and P=11 will be described as an example. Further, a center portion (the driving point is in the vicinity of one of Na to Np) of each of the P current mirror circuits 230*a* to 230*p* is connected to the main power line +VDD and is supplied with electric power therefrom. The reason for setting the 165 output pins is that a 5-bit D/A converter circuit supplied with display data corresponding to the display pixels is provided in the initial stage of the k-times drive current generator circuit 82 as a result of 165=33×5.

In this embodiment, a drive current copy circuit 24 is provide between the drive current regulator circuit 22 and the drive current generator circuit 230.

Each of the current mirror circuits 230*a* to 230*p* constituting each group of the drive current generator circuit 230 is constituted with one input side PNP bipolar transistor Qa and m output side PNP bipolar transistors Qn, which have emitters connected to the line +VDD of the power source 7, where m is 15. The input side transistor Qa in each group has a collector supplied with a reference drive current mI generated by the drive current regulator circuit 22 through the drive current copy circuit 24.

The emitter area ratio of the transistor Qa and each of the m transistors Qn is 1:1. As shown in FIG. 5, the wiring of bases of the transistor Qa and the m transistors Qn is performed by a wiring line 13, which connects the bases of the (m×P) transistors Qn commonly. In this embodiment, 11 (=P) groups of the transistors Qn are provided and the transistor Qa is arranged in substantially the center of each group. The arranging points of the transistors Qa correspond to substantially the above mentioned drive points Na to Np, respectively.

Since the number of the transistors Qn in one group is 15 and the total number of the transistors Qn is 165, the transistors Qn are not always arranged symmetrically with respect to the transistor Qa. However, it is possible to arrange the transistors Qa substantially symmetrically by arranging, for example, 8 transistors Qn, one transistor Qa, 15 transistors Qn and one transistor Qa, and then, repeating the combination of the 15 transistors Qn and the one transistor Qa nine times and finally arranging 7 transistors Qn.

The total number of the collectors of the transistors Qn is P×m (=165) and the 165 collectors are connected to the input terminals 82*a* of the k-time drive current generator circuits 82 in units of 5 collectors and collector currents are supplied to respective bit output stages of the 5-bit D/A converter circuits provided in the input stage of the k-time drive current generator circuits 82. Incidentally, n (=33) corresponds to the number of the drive pins of the column line of each of R, G and B driven by the current mirror output circuits 83.

The power supply line 12 to which the emitters of the P transistors Qn of each group are connected is connected to the line +VDD of the power source 7 at substantially the center position of the same group correspondingly to the emitter of the transistor Qa of the same group and these transistors are supplied with power therefrom.

The drive current copy circuit 24 comprises a current mirror circuit, which is constructed with a PNP transistor Q11 having an emitter connected to the power source line +VDD as an input transistor, a PNP transistor Q12 connected to the transistor Q11 in current mirror relation, a NPN transistor Q13 provided downstream of the transistor Q12 and 11 output side NPN transistors Q14 to Q24, which are connected to the transistor Q13 in current mirror relation.

A collector of the transistor Q11 is supplied with current mI from the drive current regulator circuit 22 and the transistor Q13 is driven by the output side transistor Q12 to transfer the current mI to the output side transistors Q14 to Q24.

Incidentally, the transistor Q13 has a collector connected to a collector of the transistor Q12 and an emitter grounded through a resistor R13. The output side transistors Q14 to Q24 have collectors connected to collectors of the transistors Qa of the respective groups and emitters grounded through respective resistors R14 to R24.

Incidentally, transistors Qb, Qc and Qd are provided to correct base currents of the respective current mirror circuits.

In the embodiment shown in FIG. 5, the current mirror circuits 230*a* to 230*p* having P input side driving points are driven by identical driving current currents obtained by providing such current copy circuit 24 and dividing the drive current generator circuit 23 shown in FIG. 1 by P. By dividing the output side n current mirror circuits to a plurality of groups in this manner, the output pin vs. output current characteristics shown in FIG. 6 is obtained and the luminance variation is further reduced.

This is because the knoll shaped drive current characteristics curves are obtained for the respective current mirror circuit groups 230*a* to 230*p*. In this case, the drive current in the first pin of each group becomes substantially equal to the drive current in the last pin thereof. Further, a difference between the drive current at the peak of the knoll and the drive current at either end of the knoll becomes small.

In this embodiment, the number of the output side transistors of the current mirror circuit of each group is not larger than 33 and, preferably, in a range from 10 to 25 in the current technical state.

As mentioned above, it is possible to generate P drive current groups by constructing the current mirror circuit with a plurality (P) of current mirror circuits each including a number of output transistors and an input side transistor thereof being arranged in a center thereof.

In such case, a sum of coupling capacitance between base and collector of the output transistor arranged in either end remote from the input side transistor and a parasitic capacitance of various wiring is reduced to 1/P theoretically and so it is possible to reduce transient current. In addition, the output side transistors arranged in intermediate positions are driven by the input side transistors arranged on both sides thereof.

As a result, the luminance variation is substantially eliminated. Further, even when the D/A converter circuit provided in the k-time drive current generator circuit 82 subsequent to the drive current generator circuit 23 for generating drive current corresponding to a display data is ON/OFF controlled, switching noise overlapped on the output drive current is reduced. This is because the input capacitance of the collector looked from the base of the transistor Qn is reduced when the D/A converter circuit is turned ON. As a result, white lines appearing on the display screen as noise hardly occurs.

In this embodiment too, it is possible to regulate the reference current mI by the laser trimming fuses Hb1 to Hbn and Hc1 to Hcn provided in the drive current regulator circuit 22 as in the embodiment shown in FIG. 1.

In the embodiments described hereinbefore, the drive current regulator circuit for selecting the resistance value by laser trimming is not limited thereto and it is any provided that the drive current can be regulated thereby.

Further, the drive current regulator circuit may be arranged in any position between the input stage for generating the reference current and the output stage for current-driving the pins of the organic EL panel. Similarly, the D/A converter circuit responsive to the display data may be arranged in any position between the input stage and the output stage.

The 1:m current mirror circuit and the 1:k current mirror circuit are the so-called current amplifiers and, therefore, they may be usual current amplifier circuits.

The current drive circuit may be for monochromatic display and, therefore, it is not always necessary to provide current drive circuits correspondingly to R, G and B.

In the present invention, it is possible to provide a plurality of transistors Qa functioning as an input side of a current mirror in a center portion of each group including a plurality of output side transistors Qn.

Although, in the described embodiments, bipolar transistors are used mainly, it is of course possible to substitute MOS FET's for the bipolar transistors. Further, PNP (or P channel) transistors may be used in lieu of the NPN (or N channel) transistors and NPN (or N channel) transistors may be used in lieu of the PNP (or P channel) transistors. In such case, the power source voltage is negative and transistors on upstream side are provided downstream side.

What is claimed is:

1. An organic EL drive circuit comprising:

a first current mirror circuit provided in a drive stage of a current drive circuit having an output stage for current-driving terminals of an organic EL display panel and having n output side transistors connected in current mirror relation to an input side drive transistor, for driving said output stage, where n is an integer equal to or larger than 30; and a drive current regulator circuit for regulating drive current of said input side drive transistor, said input side drive transistor being arranged in a center portion of an arrangement of said n output side transistors, an output current of said output stage being regulated by said drive current regulator circuit.

2. An organic EL drive circuit as claimed in claim 1, wherein said drive current regulator circuit is regulated during a fabrication of an IC such that the output current for at least a specific one of said column terminals of said organic EL panel or a current of said output side transistors for said specific terminal becomes a predetermined value.

3. An organic EL drive circuit as claimed in claim 2, wherein said current drive circuit includes a reference current generator circuit in an input stage thereof and a second current mirror circuit driven by said output side transistors of said first current mirror circuit, said second current mirror circuit being provided for each of said terminals of said organic EL display panel and driving said output stage by generating a drive current k times the drive current, where k is an integer equal to or larger than 2.

4. An organic EL drive circuit as claimed in claim 2, wherein said output stage includes a third current mirror circuit for generating a drive signal L times the drive current where L is an integer equal to or larger than 2, said input side drive transistor of said first current mirror circuit arranged in said center portion and a wiring line for supplying power to said n first output side transistors are connected to a power line at positions in said center portion.

5. An organic EL drive circuit as claimed in claim 3, wherein said n first output side transistors are provided for each of R, G and B for a color display, said column terminals are assigned to R, G and B sequentially, said terminal for regulating said currents to predetermined value is selected from the 1st to 3rd terminals and the (n−2)-th to the n-th terminals of said n terminals of each of R, G and B.

6. An organic EL drive circuit as claimed in claim 1, wherein said first current mirror circuit is divided to a plurality of sub current mirror circuits and an input side transistor of each of said sub current mirror circuits is arranged in a center portion of a plurality of output side transistors of said sub current mirror.

7. An organic EL drive circuit as claimed in claim 6, wherein the number of said output side transistors of the plurality of said sub current mirror circuits is within a range from 10 to 25.

8. An organic EL drive circuit as claimed in claim 1, wherein a plurality of said input side transistors are provided in said first current mirror circuit, said n output side transistors of said first current mirror circuit are divided to a plurality of groups such that the number of said output side transistors in each of said groups is substantially equal and each of said input side transistors is arranged in substantially a center portion of each of said groups.

9. An organic EL drive circuit as claimed in claim 8, wherein the number of said output side transistors of said sub current mirror circuits is within a range from 10 to 25.

10. An organic EL drive circuit as claimed in claim 8, wherein said drive current regulator circuit is regulated during in a fabrication of an IC such that the output current for at least a specific one of said column terminals of said organic EL panel or a current of said output side transistors for said specific terminal becomes a predetermined value.

11. An organic EL drive circuit as claimed in claim 10, wherein said current drive circuit includes a second current mirror circuit driven by said output side transistors of said first current mirror circuit, said second current mirror circuit being provided for each of said terminals of said organic EL display panel and driving said output stage for generating a drive current k times the drive current, where k is an integer equal to or larger than 2.

12. An organic EL display device comprising:

an organic EL display panel;

a first current mirror circuit provided in a drive stage of a current drive circuit having an output stage for current-driving terminals of an organic EL display panel and having n output side transistors connected in current mirror relation to an input side drive transistor, for driving said output stage, where n is an integer equal to or larger than 30; and a drive current regulator circuit for regulating drive current of said input side drive transistor, said input side drive transistor being arranged in substantially a center portion of an arrangement of said n output side transistors, an output current of said output stage being regulated by said drive current regulator circuit.

13. An organic EL display device as claimed in claim 12, wherein said drive current regulator circuit is regulated during a fabrication of an IC such that the output current for at least a specific one of said column terminals of said organic EL panel or a current of said output side transistors for said specific terminal becomes a predetermined value.

14. An organic EL display device as claimed in claim 13, wherein said current drive circuit includes a reference current generator circuit in an input stage thereof and a second current mirror circuit driven by said output side transistors of said first current mirror circuit, said second current mirror circuit being provided for each of said terminals of said organic EL display panel and driving said output stage by generating a drive current k times the drive current, where k is an integer equal to or larger than 2.

15. An organic EL drive circuit as claimed in claim 2, wherein said output stage includes a third current mirror circuit for generating a drive signal L times the drive current where L is an integer equal to or larger than 2, said input side drive transistor of said first current mirror circuit arranged in said center portion and a wiring line for supplying power to said n first output side transistors are connected to a power line at positions in said center portion.

16. An organic EL display device as claimed in claim 12, wherein said first current mirror circuit is divided to a plurality of sub current mirror circuits and an input side transistor of each of said sub current mirror circuits is arranged in a center portion of a plurality of output side transistors of said sub current mirror.

17. An organic EL display device as claimed in claim 16, wherein the number of said output side transistors of the plurality of said sub current mirror circuits is within a range from 10 to 25.

18. An organic EL display device as claimed in claim 12, wherein a plurality of said input side transistors are provided in said first current mirror circuit, said n output side transistors of said first current mirror circuit are divided to a plurality of groups such that the number of said output side transistors in each of said groups is substantially equal and each of said input side transistors is arranged in substantially a center portion of each of said groups.

19. An organic EL display device as claimed in claim 18, wherein the number of said output side transistors of said sub current mirror circuits is within a range from 10 to 25.

20. An organic EL display device as claimed in claim 19, wherein said drive current regulator circuit is regulated during a fabrication of an IC such that the output current for at least a specific one of said column terminals of said organic EL panel or a current of said output side transistors for said specific terminal becomes a predetermined value.

* * * * *